United States Patent [19]

Durham

[11] 4,116,349

[45] Sep. 26, 1978

[54] FORK LIFT LOAD CLAMPING AND STABILIZING DEVICE

[76] Inventor: Harvey E. Durham, Box 164, Manila, Ark. 72442

[21] Appl. No.: 785,633

[22] Filed: Apr. 7, 1977

[51] Int. Cl.[2] ..... B66F 9/18

[52] U.S. Cl. ..... 214/654; 100/100; 280/179 R; 294/67 AB

[58] Field of Search ..... 214/654, 655, 651, 653; 294/67 AB, 77; 100/100; 280/179 R

[56] References Cited

U.S. PATENT DOCUMENTS

| | | | |
|---|---|---|---|
| 2,875,912 | 3/1959 | Thresher | 214/654 |
| 3,563,341 | 2/1971 | Bultman | 187/9 R |
| 3,773,202 | 11/1973 | Dutra | 214/653 |

FOREIGN PATENT DOCUMENTS

| | | | |
|---|---|---|---|
| 532,056 | 10/1956 | Canada | 214/654 |

*Primary Examiner*—Albert J. Makay
*Assistant Examiner*—George F. Abraham
*Attorney, Agent, or Firm*—Dowell & Dowell

[57] ABSTRACT

A load clamping and stabilizing device for attachment to the fork mounting carriage of a fork lift truck so that the device is elevated with the carriage as it moves in its upright lift frame, the device including guide rail members spaced transversely of the truck and attached to the carriage and including slide members telescopically supported by the guide rail members and power driven up and down by force-limited motor driven rack and pinion actuating means, and the slide members supporting a load clamping frame extending forwardly therefrom and overlying the lift forks and having a yieldable load engaging web supported in the clamping frame for descending onto a load and shaping itself over the top of the load and gripping it to clamp and stabilize the load.

4 Claims, 4 Drawing Figures

FORK LIFT LOAD CLAMPING AND STABILIZING DEVICE

FIELD OF THE INVENTION

This invention relates to a load clamping device for attachment to the fork mounting carriage of a fork lift truck, the device being power driven to bring a clamping frame downwardly to clamp and stabilize a load supported by the forks, and the whole clamping device then moving with the carriage as the elevation of the load is changed.

BACKGROUND AND PRIOR ART

The prior art includes showings of load stabilizers mounted as attachments on fork lift trucks. U.S. Pat. No. 3,174,639 to Chase et al., shows a positionable upper frame which telescopes laterally to stabilize the upper end of a load against tipping. U.S. Pat. No. 3,455,476 to Grigsby shows a horizontal arm which supports the outer end of a load to hold it up and stabilize it, but not as a downward acting clamp. U.S. Pat. No. 2,578,802 to Heidrick et al., shows a downward clamping frame which impales baled hay to clamp it. U.S. Pat. No. 3,433,376 to Jordan, shows sidewardly acting frames for grabbing and supporting a load using resiliently faced grab members, but not downwardly cooperating with lift forks by clamping downwardly theretoward. U.S. Pat. No. 3,563,341 to Bultman shows a fork lift jack without a clamping frame but wherein the main fork supporting carriage is driven by pinion means running against stationary racks supported on the main lift frame.

THE INVENTION

This invention comprises a device in the form of an attachment carried on a fork-supporting carriage which can be elevated in a lift frame, the attachment being shown fitted to a well known type of fork lift truck, for example, of the type shown in U.S. Pat. No. 3,027,033 to Schuster. The attachment includes upright guide rail members secured directly to the lift carriage and in turn carrying slide members telescopingly supported on the guide rail members. The slide members in turn support a clamping frame extending forwardly therefrom above the forks which are mounted on the carriage, and the clamping frame has a yieldable web supported around its outer edge by the clamping frame. Rack and pinion means drive the slide members, and therefore the clamping frame, up and down with respect to the guide rail members and the fork carriage when the pinions are rotated by a motor actuator driven by a source of power in the lift truck. An hydraulic motor drive is preferred because it is so easy to control the hydraulic pressure delivered to it to limit the maximum driving force so that the clamping frame and web exert just the right amount of clamping pressure, i.e. sufficient that the yieldable web is shaped around the top of the load to both clamp and stabilize the load but limited to prevent crushing the load or rupturing the stretchable members comprising the yieldable web.

OBJECTS OF THE INVENTION

It is a principal object of this invention to provide a load clamping and stabilizing device for attachment to a fork lift truck in such a way that the clamping device moves up and down with the fork mounting carriage of the truck, and more particularly, it is an object of the invention to provide a clamping and stabilizing device wherein the load to be clamped by the device is contacted by a yieldable web pulled downwardly by a clamping frame in such a manner that the web allows the clamping frame to surround and go below the level of the top of the load while the yieldable web shapes itself to fit over the top of the load and stretch as the frame is pulled downwardly. This is a particular advantage in a clamping device of this type because the operator of the lift truck sits at a level which is frequently below the top of the load being picked up on the forks, whereby he cannot see the top of the load, and must therefore depend upon the resilience and yieldability of the web to prevent damage to the load, while at the same time applying to it a substantial downward clamping force.

It is another important object of the invention to provide actuator means for positively driving the clamping frame both upwardly and downwardly with respect to the lift forks. The driving force is adjustable, whereby a downward force can be applied to the load whose maximum clamping pressure is controlled by preadjustment of an hydraulic relief valve system, or regulator system. This is of particular advantage to the operator of a lift truck when lowering the clamping frame to stretch the yieldable web over the top of the load where the top of the load is above the level of the operator's eyes, because the operator will be free simply to actuate the control lever to move the frame downwardly until the frame stops descending because of the force limiting action of the relief valve or regulator. In this way, the operator is relieved that the necessity of judging visually when an adequate but non-damaging amount of downward clamping pressure has been applied, since as mentioned above the operator frequently cannot see the top of the load to make such a visual determination. Even when lifting low loads, the operator's view of the load is often severely restricted by the lift frame and the carriage elevator mechanisms.

It is a further object of the invention to provide a yieldable web within the clamping frame, where the web is made of stretchable members which are mutually crossing, and/or interwoven, the stretchable members being made of a suitable elastomeric material such as rubber, or alternatively comprising spring loaded cords, or specially woven fabric made of stretchable yarn. The yieldable characteristics of these stretchable web members should be interrelated to the amount of clamping-force drive which can be preset for exertion by the hydraulic actuator means by adjusting the relief valve or regulator devices limiting the hydraulic motor pressure. It is of course possible to use actuators other than hydraulic means, although the latter are very convenient because most lift trucks have the hydraulic capability built into them already.

Still another object of the invention is to provide a sturdy telescoping support means for the clamping device, the preferred embodiment showing a support means comprising upright guide rail members secured to the fork-lift carriage, and in turn supporting upright slide means which carry rollers which run in slots in the guide rail members, thereby providing a substantially friction free sliding engagement therebetween. This structure lends itself well to a rack and pinion type of drive using the hydraulic motor to rotate a shaft which carries pinions engaging rack teeth on the slide members for driving them up and down. The teeth of the rack and also the pinion drive shaft are displaced away from the lifting forks in order to reduce to as great an extent as possible the liklihood that materials being picked up as load by the truck might become fouled in the rack and pinion drive. The relatively remotely located rack and pinion arrangement of the present invention is believed to be a considerable practical improvement over the central piston means shown for instance in U.S. Pat. Nos. 3,174,639 and 3,455,476, wherein the central piston arrangements not only increase the liklihood of entanglement with materials being clamped, but also hide the load to a considerable extent from the vision of the operator of the lift truck who is usually seated on the other side of the elevating and clamping arrangement from the load itself.

Other objects and advantages of the invention will become apparent during the following discussion of the drawings which show an illustrative embodiment of the invention:

THE DRAWINGS

Figure 1:
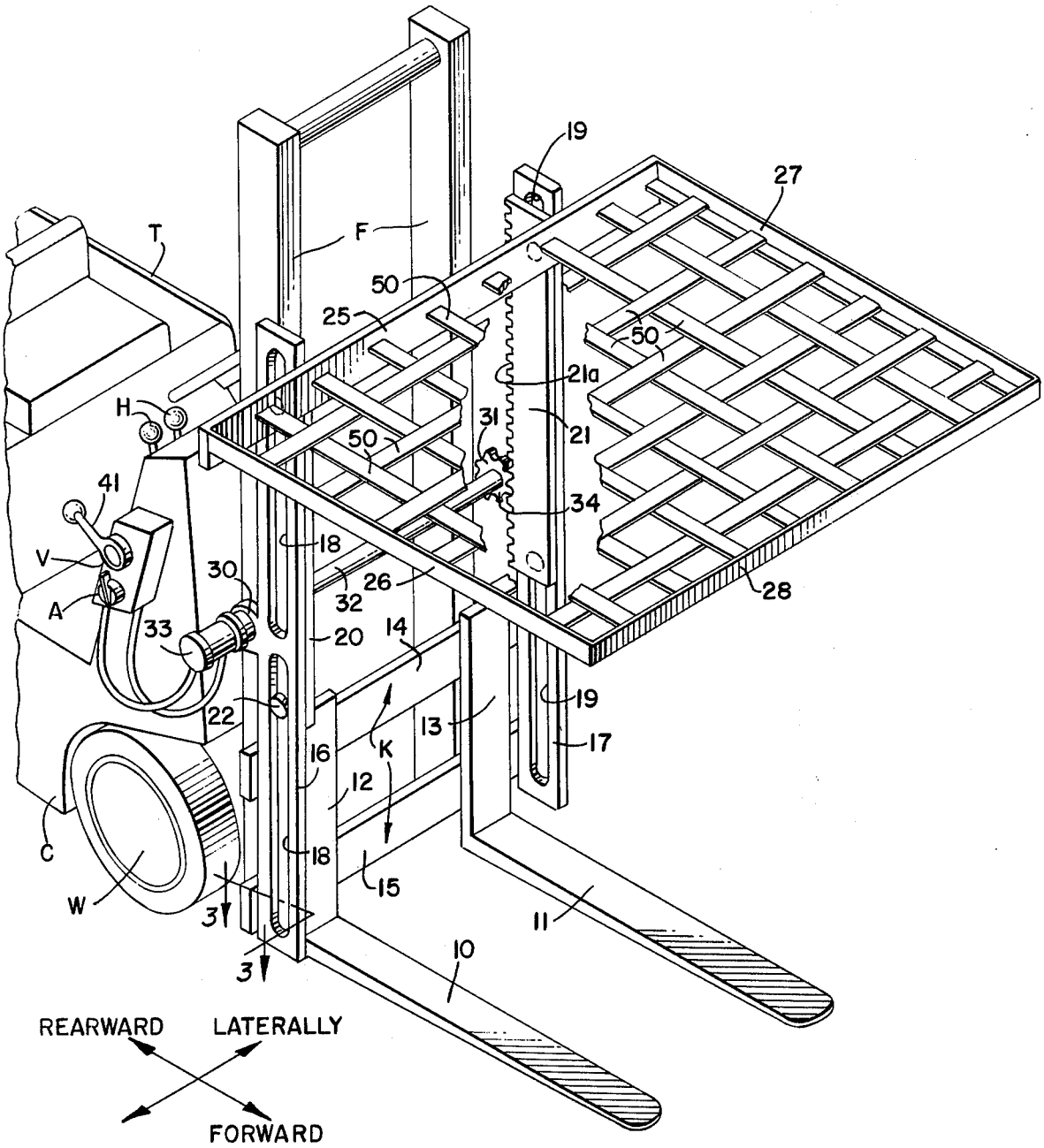
FIG. 1 is a perspective view of a lift truck with the present load clamping and stabilizing device attached thereto.
Figure 2:
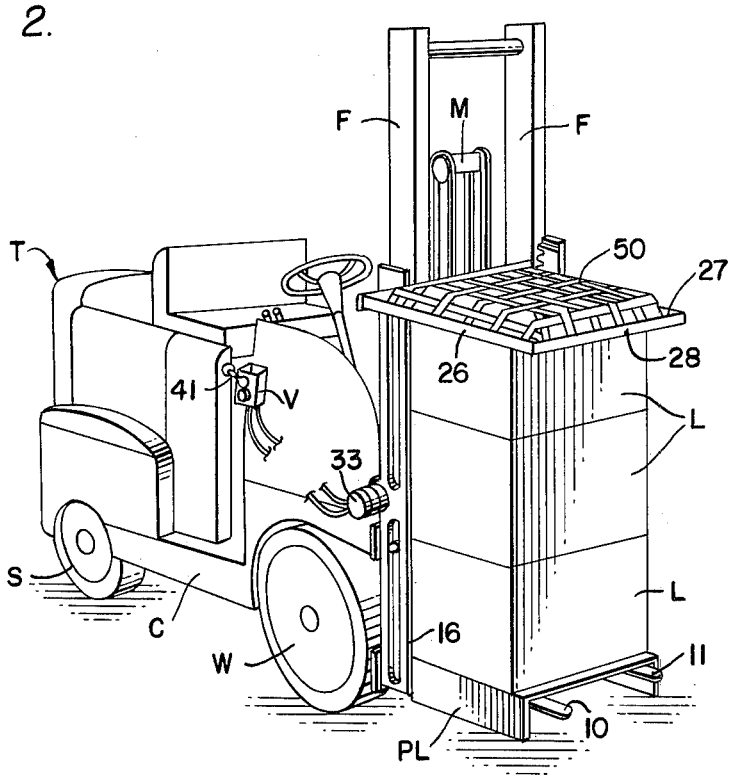
FIG. 2 is a perspective view on a smaller scale showing the load clamping and stabilizing device gripping a load on the truck.

Referring now to the illustrative drawings, and particularly to FIGS. 1 and 2, the device according to the invention is attached to a standard fork lift truck, the one shown in the drawings, for example, being of the type illustrated in U.S. Pat. No. 3,027,033, as mentioned above. The truck T comprises a pair of forward load bearing wheels W, a pair of steerable rear wheels S, and a chassis C supporting an upright lift frame F. As can be seen in FIG. 1, the lift frame F supports a fork mounting carriage K, which is raised and lowered by an elevator mechanism M, as well known in the prior art. The vehicle is provided with hydraulic controls H of standard type which serve to raise and lower the carriage K on the lift frame using hydraulic pressure from a pressure source P illustrated in FIG. 4, the pressure source in most cases being part of the standard lift truck. Another of the hydraulic controls H may serve to tilt the frame F about the chassis. The mechanism by which the lift frame F is tilted, and the carriage K is raised and lowered in the lift frame F, form no part of the present invention, the latter being merely referred to in FIG. 2 in a general way by the reference character M. The carriage K carries two forks labelled 10 and 11 having upright portions 12 and 13 which are secured as by welding to horizontal members 14 and 15 which form part of the carriage K. The members 10 through 15 are also part of the standard truck.

Figure 3:
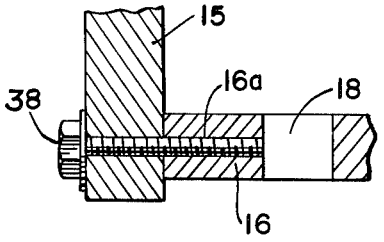
FIG. 3 is a partial sectional view taken along line 3—3 of FIG. 1.

The clamping and stabilizing device according to this invention is an attachment which comprises two spaced upright guide rail members 16 and 17 which are respectively secured to the four outer ends of the carriage members 14 and 15 by any suitable means, such as bolts 38 entering tapped holes **16*a* in the appropriate upright guide member 16, or similar holes in the upright guide member 17, as shown in detail in FIG. 3. Thus, in order to install the attachment it is only necessary to drill eight holes in the appropriate locations through the horizontal members 14 and 15 of the carriage K. When so mounted, the upright guide rail members 16 and 17** become part of the carriage K and are raised and lowered therewith when the carriage goes up and down.

Each of the upright guide rail members has longitudinal slots 18 and 19. There are two clamping frame supporting slide members 20 and 21, both having toothed racks on their rearward facing edges, such as the racks **21*a* as seen in FIG. 1. The upright guide rail members support the slide members 20 and 21 which are provided with rollers, such as the roller 22 as seen in FIG. 1 which roll in the slots 18 of the upright guide member 16 or the slots 19 of the upright guide member 17 so as to permit the slide members 20 and 21 to move elevationally with respect to the guide rail members 16 and 17**. The slide members thus perform a sort of telescopic vertical movement with respect to the guide rail members.

Each of the slide members 20 and 21 is secured at its upper end to a clamping frame member 25, the frame having side members 26 and 27 and a front member 28. The forward and rearward frame members 28 and 25, and the side frame members 26 and 27 are respectively spaced far enough apart so that they can cover a wider load than the spacing of the two forks 10 and 11, and so that they extend out forwardly almost as far as the tip ends of the forks. In this way, when the forks pick up a load on a pallet PL as shown in FIG. 2 the frame members 25, 26, 27 and 28 will be able to descend below the top of the load on the pallet so as to surround the load in a manner to be hereinafter discussed.

The upright guide rail members 16 and 17 have rearwardly extending bosses 30 and 31 which have aligned bearing holes through them receiving a shaft 32 which is coupled with a motor 33. The motor rotates the shaft 32 when actuated by an hydraulic pressure system, which will be presently described in connection with FIG. 4. The shaft carries two spaced pinion gears, only the far pinion gear 34 being visible in FIG. 1. The second gear is located next to the boss 30, and engages rack teeth on the rearward side of the slide member 20, which are likewise not visible in the present drawings. When the shaft 32 is rotated by the motor 33, the pinion gears, such as the gear 34, drive the slide members 20 and 21 up and down to position them elevationally, thereby changing the distance between the frame 25, 26, 27 and 28, and the forks 10 and 11 located directly therebeneath.

Figure 4:
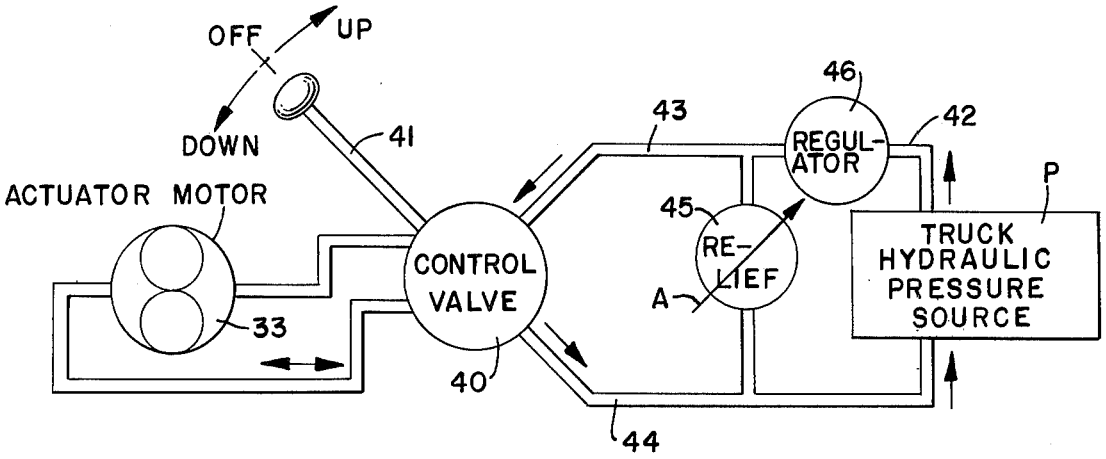
FIG. 4 is a schematic hydraulic circuit showing the hydraulic motor actuating system which operates the clamping and stabilizing device of the invention.

FIG. 4 shows an hydraulic system suitable to actuate the motor 33. A valve conrol box V is located on the side of the truck in convenient position for the operator, and it includes a control valve 40 whose handle 41 is visible in FIG. 1. The control valve 40 has three positions, including an "off" position in the center, and an "up" position above it, and a "down" position below it. In the "off" position, the motor 33 is locked. When the handle 41 is raised to the "up" position, hydraulic fluid under pressure is drawn through the hydraulic line 42, through the line 43, and delivered to one of the hydraulic lines on the other side of the valve 40 going to the motor 33 so as to make the motor rotate in a direction which will raise the two slide members 20 and 21 to which the clamping frame member 25 is attached. When the handle is moved to the "down" position, the control valve 41 reverses the direction of flow of hydraulic fluid through the motor 33 and causes the shaft 32 to rotate in such a direction as to drive the rack teeth on the rear edges of the slide members 20 and 21 downwardly. The return flow of fluid from the low pressure side of the motor passes through the hydraulic line 44 back into the hydraulic source of pressure P within the truck itself. The valve box V has an adjustable pressure determining means on it labelled A by which either a relief valve 45 and/or regulator 46 can be manually adjusted by the operator to limit the maximum operating pressure delivered to the motor 33, and thereby adjust the maximum downward thrust which can be applied to the slide members 20 and 21 to drive the clamping frame downwardly into clamping relationship with the load L carried by the forks 10 and 11.

As can be seen in FIGS. 1 and 2, the clamping frame comprising the members 25, 26, 27 and 28 is open in the center and supports a clamping web which is yieldable. This web 50 can either be a non-stretch web supported around its edges on stretchable members, or it can be a web which is made entirely of yieldable and stretchable members, for instance rubber. In the illustrated embodiment the web is woven of stretchable rubber members 50 which are attached at their outer ends to the frame, and which stretch when the frame is pulled downwardly over the top of a load L as illustrated in FIG. 2.

There is an interrelationship between the setting of the manually adjusted hydraulic pressure determining means, as performed by the operator of the lift truck using the adjustment A, and the strength and yield of the stretchable web members 50 within the clamping frame. The adjustment of the hydraulic pressure level control A should be made such that if the operator holds the valve arm 41 in the "down" position, the frame will drive down around the load L only to such an extent as to stretch the yieldable web 50 as shown in FIG. 2 without breaking it, and at the same time without crushing the load L as carried on the pallet PL. Thus, pressure limiting means is provided by which an operator can preset the amount of clamping force applied to the load for the purpose of protecting the load against damage, as well as for the purpose of protecting the web 50 within the clamping frame 25, 26, 27 and 28 from rupturing.

This invention is not to be limited to the exact form shown in the drawings, for obviously changes can be made within the scope of the following claims.

I claim:

1. A load clamping and stabilizing device for attachment to the fork mounting carriage of a fork lift truck having a source of power, the carriage being guided and power driven for elevational movement in an upright lift frame supported on the forward end of the truck and having fork members extending forwardly from the carriage, the device comprising:

(a) a pair of upright guide rail members spaced transversely of the truck and disposed upright parallel to the lift frame, and each guide rail member being attached to and supported by said carriage for elevational movement therewith;

(b) a pair of upright slide members supported parallel to the guide rail members on guide rollers operative between the rail and slide members to permit relative elevational movement therebetween;

(c) a load clamping frame secured to the upright slide members, the frame extending forwardly of the truck over the fork members and having a yieldable load engaging web in the clamping frame;

(d) actuating means driven by said source of power and operative between the rail members and the slide members for selectively positioning the slide members and the clamping frame elevationally with respect to the rail members and the fork mounting carriage; and (e) each upright guide rail member supporting a bearing aligned transversely of the truck with a bearing supported in the other upright rail member; a shaft journaled in said bearings, the shaft and bearings being offset rearwardly of the truck on the other side of the rail members from the fork members and spaced from the slide members; each slide member having rearwardly facing edges provided with rack teeth extending toward the shaft; pinion means fixed on the shaft and engaging the rack teeth on each slide member; and said actuating means including a reversible motor coupled to rotate the shaft and connected by control means to said source of power.

2. In a load clamping and stabilizing device as set forth in claim 1, said guide rail members having guide slots in which said guide rollers run, and said slide members being respectively located immediately adjacent to said rail members and each slide member carrying means rotatably supporting rollers in said slots.

3. A load clamping and stabilizing device for attachment to the fork mounting carriage of a fork lift truck having a source of power, the carriage being guided and power driven for elevational movement in an upright lift frame supported on the forward end of the truck and having fork members extending forwardly from the carriage, the device comprising:

(a) a pair of upright guide rail members spaced transversely of the truck and disposed upright parallel to the lift frame, and each guide rail member being attached to and supported by said carriage for elevational movement therewith;

(b) a pair of upright slide members supported parallel to the guide rail members on guide rollers operative between the rail and slide members to permit relative elevational movement therebetween;

(c) a load clamping frame secured to the upright slide members, the frame extending forwardly of the truck over the fork members and having a yieldable load engaging web in the clamping frame comprising a grid of mutually crossing stretchable members supported at their ends by the clamping frame; and (d) actuating means driven by said source of power and operative between the rail members and the slide members for selectively positioning the slide members and the clamping frame elevationally with respect to the rail members and the fork mounting carriage, said actuating means being reversible and including means for positively driving the slide members downwardly to bring the clamping frame below the top of the load and thereby stretch said yieldable members over the top of the load and shape them thereto.

4. In a load clamping and stabilizing device as set forth in claim 3, said source of power comprising a source of hydraulic pressure, and said reversible actuating means comprising an hydraulic motor, control valve means coupling the motor to said source, and adjustable pressure determining means limiting the hydraulic pressure deliverable to the motor through the valve, whereby to limit by pre-adjustment the maximum clamping force deliverable to the load by said stretchable members of the load engaging web.

* * * * *